US005142959A

United States Patent [19]

Sakamoto et al.

[11] Patent Number: 5,142,959

[45] Date of Patent: Sep. 1, 1992

[54] MIDI CONTROL APPARATUS AND MIDI SYSTEM

[75] Inventors: Masaharu Sakamoto; Shigeru Yamaguchi; Kazuhiko Mukai; Yukio Matsumoto; Shinji Suzuki; Toshiyuki Katsu; Tatsushi Iizuka; Kiyomi Yatsuhashi; Hidenori Hidaka, all of Tokyo, Japan

[73] Assignee: Pioneer Electronic Corporation, Tokyo, Japan

[21] Appl. No.: 637,671

[22] Filed: Jan. 8, 1991

[30] Foreign Application Priority Data

Jan. 10, 1990 [JP] Japan ..... 2-3260

Jul. 31, 1990 [JP] Japan ..... 2-203725

[51] Int. Cl.[5] ..... G10H 1/00

[52] U.S. Cl. ..... 84/645; 84/DIG. 29

[58] Field of Search ..... 84/601-646, 84/DIG. 12, DIG. 22, DIG. 29

[56] References Cited

U.S. PATENT DOCUMENTS 5,038,660 8/1991 Watanabe ..... 84/601

*Primary Examiner*—Stanley J. Witkowski

*Attorney, Agent, or Firm*—Wegner, Cantor, Mueller & Player

[57] ABSTRACT

A MIDI apparatus and a MIDI system wherein an operation ON signal for starting operation to a MIDI instrument and an operation OFF signal for stopping the operation are obtained and supplied to the MIDI instrument in response to a MIDI format signal included in a subcode signal generated during play of a record medium play apparatus. If the play state of the record medium play apparatus becomes discontinuous, such as a pause after the operation ON signal is supplied to the MIDI instrument and before the operation OFF signal corresponding to the operation ON signal is obtained, the operation OFF signal is forcedly supplied to the MIDI instrument. Thereby such the sound of the MIDI instrument is stopped when there is a discontinuous play state after the operation ON signal is supplied to the MIDI instrument and before the operation OFF signal corresponding to the operation ON signal would ordinarily be supplied.

4 Claims, 8 Drawing Sheets

FIG.5

| SYMBOL | R S T U | V W |
|---|---|---|
| 0 | MODE | ITEM |
| 1 | INSTRUCTION | |
| 2 | PARITY | Q0 |
| 3 | PARITY | Q1 |
| 4 | DATA FIELD | |
| 5 | | |
| ⋮ | | |
| 19 | | |
| 20 | PARITY | P0 |
| 21 | PARITY | P1 |
| 22 | PARITY | P2 |
| 23 | PARITY | P3 |

MIDI CONTROL APPARATUS AND MIDI SYSTEM

BACKGROUND OF THE INVENTION

1. Field of the Invention

The present invention relates to a MIDI (Musical Instrument Digital Interface) control apparatus to control a MIDI instrument and a MIDI system incorporating such a control apparatus.

2. Description of the Related Art

A MIDI standard is necessary in order that musical instruments such as a synthesizer or an electronic piano can be connected to each other and exchange of information therebetween is possible.

An electronic musical instrument provided with hardware according to such MIDI standard and having the function of transmitting/receiving MIDI control signals as instrument play control signals with form defined to carry musical information is called a MIDI instrument.

In discs such as CD (compact disc) , CD-V (video), LD (laser disc) including CD format digital audio and tapes used by a tapedeck such as a DAT (Digital Audio Tape), a subcode carrying play control information or the like is recorded. The subcode is constituted by P, Q, R, S, T, U, V, W channels, and among these, the P and Q channels are used as control signals for a disc player.

On the other hand, the R - W channels become empty channels called user's bits, and various applications are studied such that information of graphic, voice, picture or the like is recorded, and a standard regarding a graphic format has been always proposed.

MIDI format signal can be also recorded in the user's bits, and a standard regarding this has been already proposed. In this case, not only is the audio video signal reproduced by the disc player is supplied to AV (Audio Visual) system and the program recorded in the disc is viewed and heard but also the play program information can be supplied to one or more MIDI instruments placed side by side with the AV system, thereby forming an AV system with presence including electronic musical instruments, the preparation of software for the education and other various applications are studied.

The MIDI instrument plays in accordance with the instrument play program formed by the MIDI signal and MIDI format signals supplied in sequence from the disc player are converted into serial signal. However, when the disc player supplies the instrument play program, if command of the operation accompanied by a track jump or a pause operation is received, the MIDI instrument cannot continuously read out the instrument play program in the writing order of the instrument play program and therefore the continuity of the instrument play program is interrupted. As a result, a malfunction may be produced such that the sound generated from the sound source of the MIDI instrument is not stopped.

The reason will be specifically described as follows.

First, the MIDI signal supplied to the MIDI instrument is serial data of the transfer rate 31.25 [Kbaud], and one byte of data is constituted by 10 total bits including 8 bits of data a start bit and a stop bit.

In order to designate the sort of transmitted data or the MIDI channel, at least one status byte and one or two data bytes led by the status are combined, thereby forming a message as the musical information. Consequently, one message is constituted by 1-3 bytes, and a transfer time of 320-960 [$\mu$ sec] is required for the transfer. The instrument play program is formed by a series of these messages.

FIG. 1 shows the structure of a note-on-message as an example of such a message.

The note-on-message in the status byte is the command corresponding to the operation of pressing a key or keyboard, and is used in a pair along with a note-off-message corresponding to the operation of releasing the key on the keyboard. For example, as shown in FIG. 2(A), sounds 1, 2 are produced by the note-on-message, and stopped by the note-off-message corresponding to the note-on-message. The note number of the data byte 1 assigns any of 128 stages assigned to the keyboard about "the center C" of an 88-key piano. The velocity of the data byte 2 is utilized to provide differences in the intensity of the sound. The MIDI instrument receiving the note-on-message generates a sound corresponding to the scale and the assigned intensity. On receiving the note-off-message, the MIDI instrument to stops the generation of the sound.

As shown in FIG. 2(B), after the note-on-message is transmitted to the sound source and before the note-off-message is transmitted, if a track jump, such as a manual search, a track search or the like or a state occurs on an error operation such, as pause, stop or the like the continuity of the instrument play program by the MIDI signal is partially lost or the progress of the program is stopped with the lapse of time. As a result, a malfunction is produced in that the sound 1 is not stopped because there is no note-off-message. In the pause state, usually as shown in FIG. 3, a pickup performs the track jump and repeatedly traces one track T (broken line indicates other track) of the disc 1. By transfer from the play state to the pause state, the player repeatedly generates a MIDI signal including the the reapeat track and play becomes discontinuous. Particularly, when plural sorts of the sound sources are performed simultaneously so that they overlap, such a malfunction cannot be easily dealt with.

Such malfunction is not limited to a the case in which there is no note-off-message, but may also occur when the control operation, such as modulation channel pressure, pitch bent hold, or breath control must be stopped.

SUMMARY OF THE INVENTION

An object of the invention is to provide a MIDI control apparatus capable of suppressing generation of a malfunction due to a lack of the instrument play program, and to provide a MIDI system including this.

A MIDI control apparatus according to the invention supplies the operation ON signal and the operation OFF signal to a MIDI instrument in response to MIDI format signal included in subcode signal supplied from a record medium play apparatus. The MIDI control apparatus comprises a subcode decoder for decoding subcode signal and for generating MIDI signals including the operation ON signal and the operation OFF signal, storage means for storing content of the operation ON signal generated by the subcode decoder until the operation OFF signal corresponding to the operation ON signal is generated from the subcode decoder, and forced release means for supplying the operation OFF signal corresponding to content of the operation ON signal stored in the storage means to the MIDI apparatus in response to the state signal representing the discontinuous play state from the record medium play apparatus.

Also a MIDI system according to the invention includes a MIDI control apparatus for supplying the operation ON signal and the operation OFF signal to the MIDI instrument in response to the MIDI format signal decoded from the subcode signal supplied from the record medium play means. The MIDI system comprises means for generating state display signal representing the discontinuous play state of the record medium play means, a subcode decoder for decoding the subcode signal and for generating MIDI signals including the operation ON signal and the operation OFF signal, storage means for storing content of the operation ON signal generated by the subcode decoder until the operation OFF signal corresponding to the operation ON signal is generated from the subcode decoder, and forced release means for supplying the operation OFF signal corresponding to content of the operation ON signal stored in the storage means to the MIDI instrument in response to the state signal.

BRIEF DESCRIPTION OF THE DRAWINGS

FIG. 5 is a diagram illustrating a constitution example of subcode data;

DETAILED DESCRIPTION OF PREFERRED EMBODIMENTS

Figure 4:
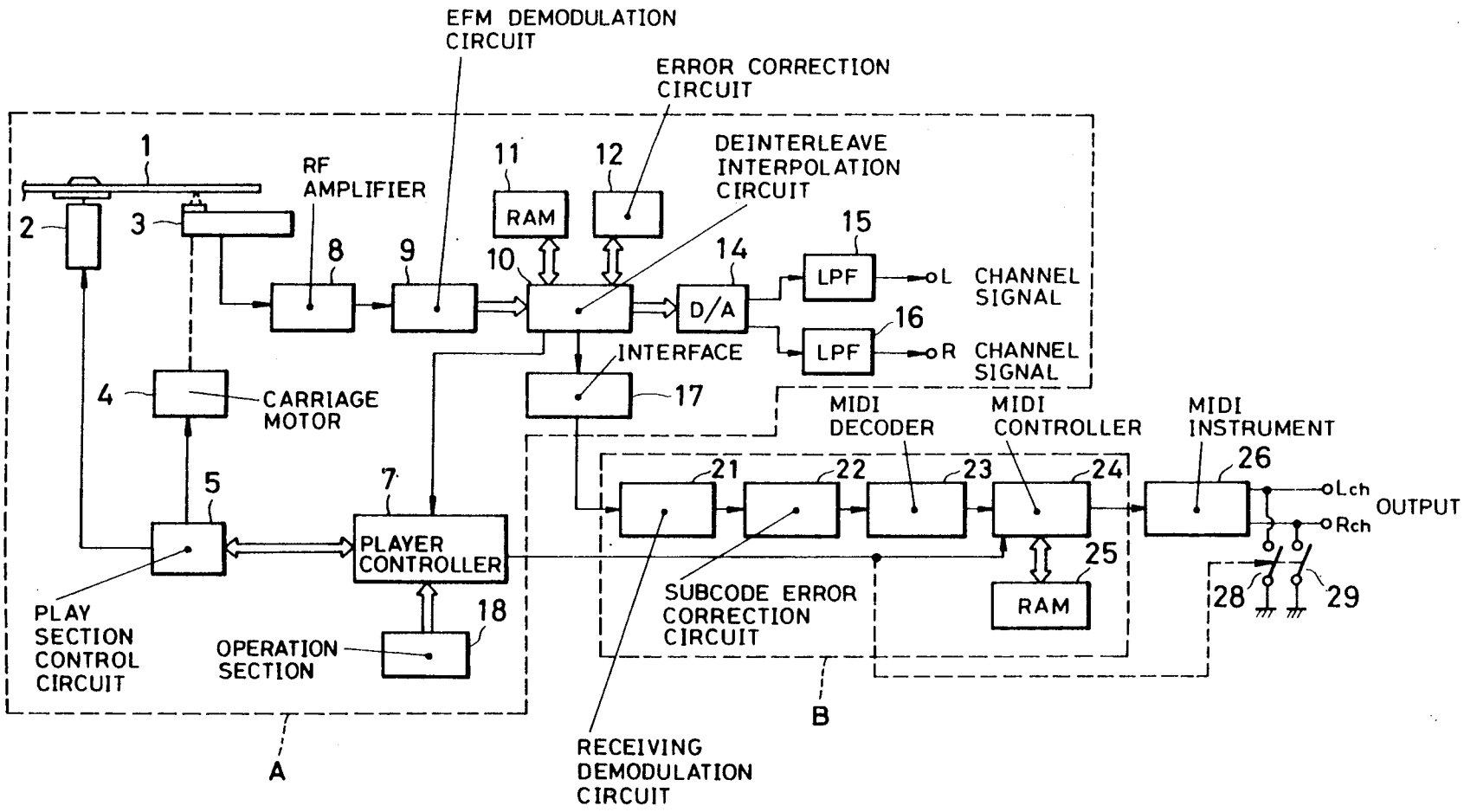
FIG. 4 is a block diagram showing an embodiment of the invention.

In FIG. 4, a disc 1 recording plural pieces of music is driven for rotation by a spindle motor 2. As the disc 1 is rotated, signals recorded in the disc 1 are read by a pickup 3. The pickup 3 is carried by a carriage (not shown) movable in the radial direction of the disc 1 via a carriage motor 4, and the information reading point information reading light spot) of the pickup 3 is freely positioned in the radial direction of the disc 1. Also various servo systems such as spindle servo system, focus servo system, tracking servo system, carriage servo system and the like are installed, and since these systems are well known, they are not shown here.

The spindle motor 2 and the carriage motor 4 are driven by the spindle servo system, the carriage servo system or a play section control circuit 5. The play section control circuit 5 drives of the spindle motor 2 and the carriage motor 4, and provides ON/OFF control of the various servo systems (not shown), jump control and the like in response to the command from a player controller 7.

A so-called RF (high frequency) signal generated from the pickup 3 is amplified by an RF amplifier 8, and then supplied to an EFM demodulation circuit 9. The EFM demodulation circuit 9 performs EFM demodulation processing of the pulse signal obtained by slicing the RF signal, and forms PCM data, i.e. , digital data and subcode including audio information of left and right channels subjected to time division multiplexing. Digital data including the audio information generated from the EFM demodulation circuit 9 are supplied to a deinterleave interpolation circuit 10. The deinterleave interpolation circuit 10 returns the digital data with the order rearranged by the interleave made during recording in cooperation with a RAM 11, and transmits the data to an error correction circuit 12. When a signal indicating impossibility of correction is generated from the error correction circuit 12, error data among the output data of the error correction circuit 12 are interpolated by the mean value interpolation method or the like. The error correction circuit 12 also performs error correction by CIRC (Cross Interleave Reed Solomon Code) and supplies digital data to the deinterleave error correction circuit 10, and outputs a signal indicating impossibility of correction when the correction is impossible.

Output data of the deinterleave interpolation circuit 10 is supplied to a D/A (digital-analog) converter 14. In the D/A converter 14, audio signals of left and right channels are reproduced. The reproduced audio signals of left and right channels are supplied to audio output terminals after removing their unnecessary components by LPFs (low pass filter) 15 and 16.

On the other hand, the digital signal generated from the deinterleave interpolation circuit 10 is generated in a form according to the digital audio interface standard. Data of the P, Q channels of the subcode are supplied to the player controller 7. The P channel is provided to performs a decision as to whether a signal is between pieces of music or during a piece of music, and a "1" is established between pieces of music and a "0" is established during a piece of music. The Q channel is used as a control code, and, for example, an address time code recorded in the Q channel is utilized in random access.

The player controller 7 is constituted, for example, by a microcomputer comprising a processor, a ROM, a RAM, a timer and the like, and the operation is performed on the basis of the data or the program stored in the ROM, RAM or the like by the command in response to the key operation supplied from an operation section 18, and then the instruction signal such as play, search, or jump is supplied to the play section control circuit 5.

On the other hand, the digital signal supplied to the MIDI control apparatus is supplied through an interface 17 and a receiving demodulation circuit 21 to a subcode error correction circuit 22, thereby so that the subcode error correction can be performed.

FIG. 5 shows a data format constitution example by R, S, T, U, V, W channels of the subcode being user's bits. In FIG. 5, symbol 0 represents sorts of data. For example, the case of mode →001 and item →001 represents data of TV graphics. Also, for example, the case of mode →011 and item →000 represents MIDI data. Symbol 1 becomes instruction mode, and the value of the MIDI byte within one pack is recorded. Data field of symbols 4–19 carries the graphic data or the MIDI data. Parity codes for error correction are added to symbols 20–23. The subcode error correction circuit 22 refers to such parity code and performs the error correction. The subcode with error corrected is supplied to a MIDI decoder 23.

The MIDI decoder 23 is a subcode decoder which takes MIDI data and decodes it into serial MIDI signal when the mode and the item of the subcode represent the MIDI data. The obtained MIDI signal is supplied through a MIDI controller 24 to a MIDI instrument 26. The MIDI controller 24 transmits a note-off-message or the like if necessary.

The MIDI controller 24 is constituted by a microcomputer or the like. When the supplied MIDI signal is the operation ON signal such as a note-on-message, the MIDI controller 24 writes it to an external RAM 25, and when the supplied MIDI signal is the operation OFF signal such as a note-off-message, the MIDI controller 24 erases the operation ON signal corresponding to the operation OFF signal from the RAM 25. In the case of a note-on-message, the content written in the RAM 25 may be only channel and note numbers but may include velocity if necessary.

In this case, the player controller 7 and the MIDI controller 24 are connected by a control line. When the play state becomes discontinuous, for example, a pause state, jump state or stop state due to operation of a stop key (not shown) of the operation section 18 in the midst of play, the player controller 7 supplies the state signal through the control line to the MIDI controller 24.

In FIG. 4, portion enclosed by broken line A is the disc player, and portion enclosed by broken line B constitutes the MIDI control apparatus. However, the invention is not limited to this, but, for example, the interface 17 may be included in the MIDI control apparatus.

Operation of a processor (not shown) within the MIDI controller 24 in the above constitution will be described.

The processor of the MIDI controller 24 as main routine performs write and erase of channel and note numbers (velocity if necessary) regarding the RAM 25. If the state signal indicating the discontinuous play state is supplied from the player controller 7 during processing of the main routine, an interrupt operation is started.

Figure 1:
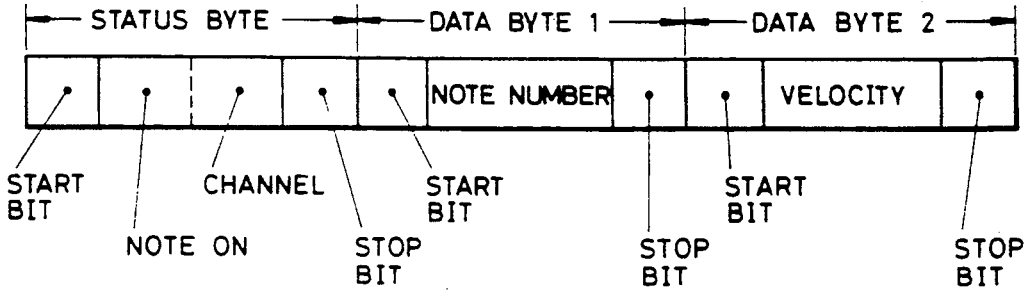
FIG. 1 is a diagram showing a constitution example of MIDI message.
Figure 2A:
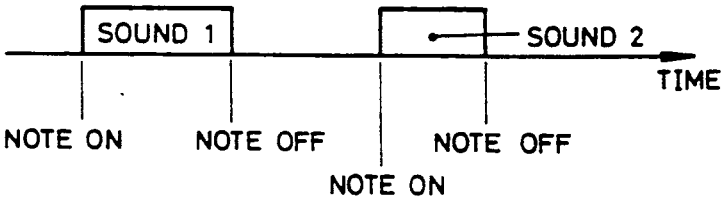
FIGS. 2(A) and (B) are diagrams illustrating generation timing of note-on-message and note-off-message.
Figure 2B:
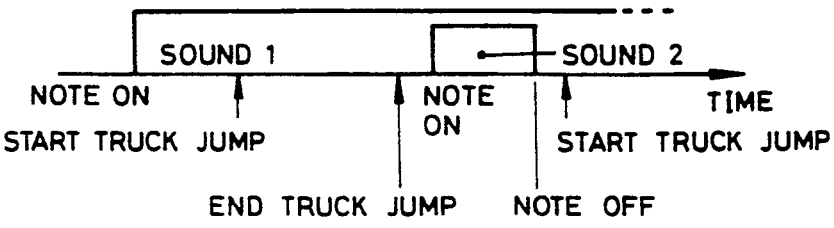
Figure 3:
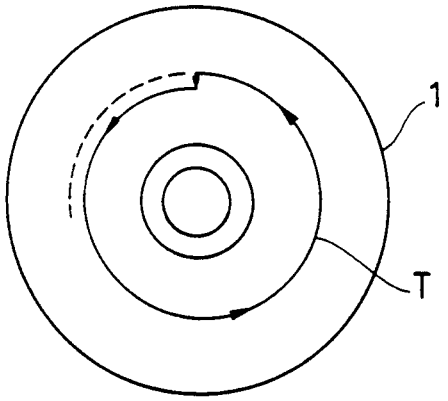
FIG. 3 is a diagram showing traces of the disc at the pause state.
Figure 6:
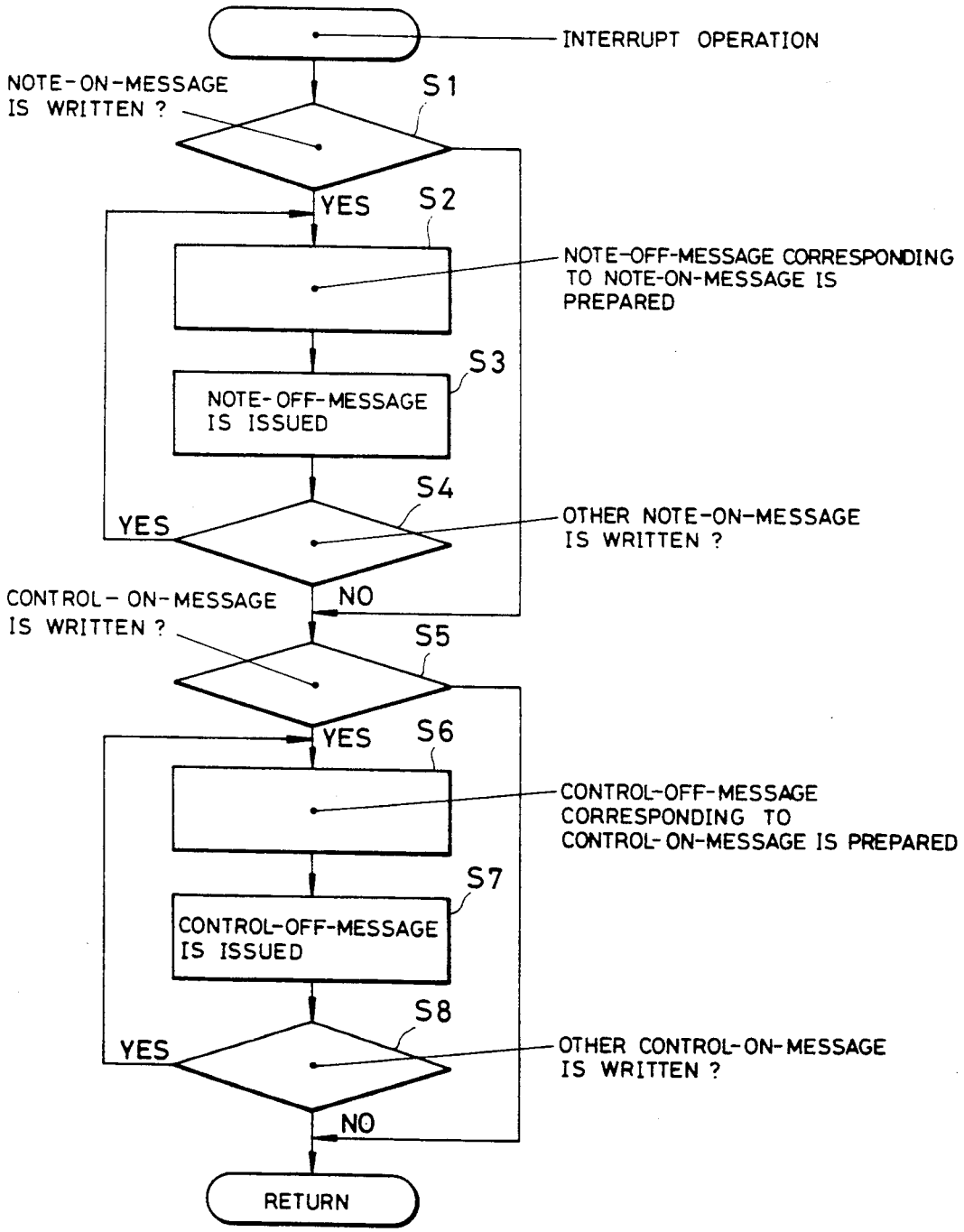
FIG. 6 is a flow chart illustrating control operation of a MIDI controller at the pause state.

In the interrupt operation, as shown in FIG. 6, a decision is effected as to whether a note-on-message is written in the RAM 25 or not (step S1). If the note-on-message is written in, the note-on-message is read out and a note-off-message corresponding to this is prepared (step S2), and the prepared note-off-message is issued from the MIDI controller 24 to the MIDI instrument 26 (step S3). Decision is effected as to whether other note-on-message is written in the RAM 25 or not (step S4), and if other note-on-message is written in, the process advances to steps S2, S3 and a note-off-message is prepared and issued. Each note-off-message is supplied to the MIDI instrument 26, thereby the sound produced by the corresponding note-on-message is stopped. In this case, a note-off-message corresponding to a note-on-message means the have the same channel and note number. For example, when the note ON/channel in the note-on-message is 90, the note number is 64, and the velocity is 40, the note OFF/channel of the note-off-message corresponding to this becomes 80, the note number becomes 64, and the velocity becomes 40. However, the velocity of the note-off-message need not be the velocity of the same as the note-on-message. The note-off-message may be formed also by adding a predetermined velocity value (e.g., 00) to the channel and the note number of the read note-on-message in the prescribed form as shown in FIG. 1. That is, for the note-on-message as above exemplified, preparation of note-off-message with note ON/channel being 90, note number being 64 and the velocity being 00 is effective. Such MIDI message is expressed by a hexadecimal number.

All note-on-messages written in the RAM 25 are read out and the note-off-message is prepared and issued, and then a decision is effected as to whether a control-on-message is written in the RAM 25 or not (step S5). Also when a decision is effected in step S1 that the note-on-message is not written in, step S5 is executed. If the control-on-message is written in the RAM 25, the control-on-message is read out and the control-off-message corresponding to this is prepared (step S6), and the prepared control-off-message is generated from the MIDI controller 24 to the MIDI instrument 26 (step S7). When the control-off-message is supplied to the MIDI instrument 26, the effect produced by the corresponding control-on-message is stopped. A decision is then effected as to whether other control-on-message is written in the RAM 25 or not (step S8), and if other control-on-message is written in, the process advances to steps S6, S7 and the control-off-message is prepared and issued. The control-off-message is prepared in a similar manner to the note-off-massage.

If a decision is effected in step S5 that the control-on-message is not written in, or if a decision is effected in step S8 that other control-on-message is not written in, the process is returned to the processing of the main routine.

The operation of a pause state as the discontinuous play state will be specifically described as follows.

If the pause state signal indicating the pause state of the mode is supplied from the player controller 7 in accordance with the pause command of the operation section 18 during processing of the main routine, a pause interrupt operation is started.

Figure 7:
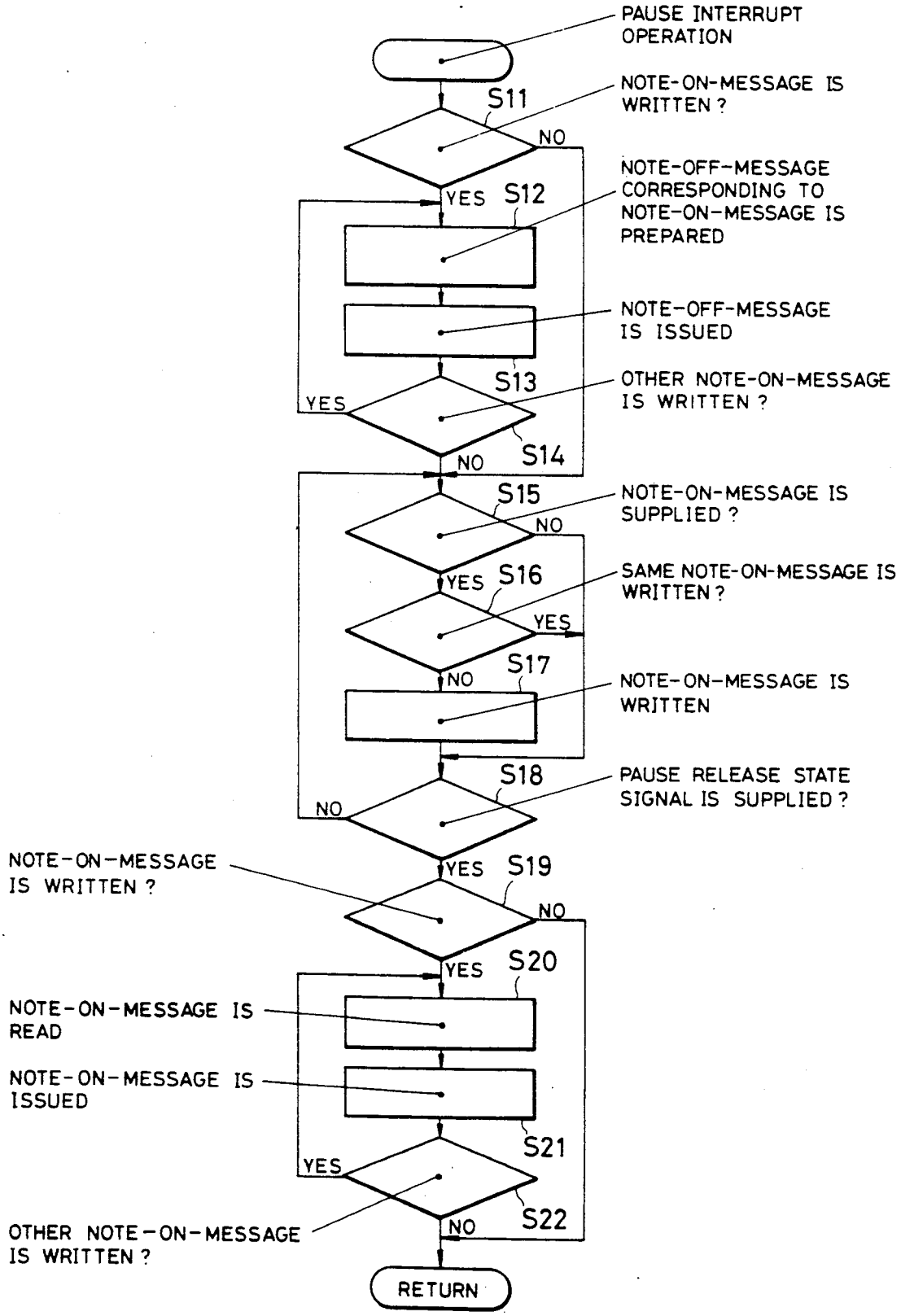
FIG. 7 is a flow chart illustrating other control operation of a MIDI controller at the pause state.

In the pause interrupt operation, as shown in FIG. 7, the MIDI controller 24 performs decision as to whether a note-on-message (channel, note number and velocity) during sound generation is written in the RAM 25 or not (step S11). If the note-on-message is written, the note-on-message is read out and a note-off-message corresponding to this is prepared (step S12), and the MIDI signal comprising the prepared note-off-message is issued from the MIDI controller 24 to the MIDI apparatus 26, and the content of the note-on-message written in the RAM 25 is erased (step S13). A decision is effected as to whether other note-on-message is written in the RAM 25 or not (step S14), and if other note-on-message is written in, the process advances to step S12 and the above operation is repeated.

If other note-on-message is not written in the RAM 25, after the pause state, a decision is effected as to whether the MIDI signal indicating the note-on-message is supplied from the MIDI decoder or not (step S15). If it is, a decision is effected as to whether other note-on-message being the same as the note-on-message is written in the RAM 25 or not (step S16). In the case of the note-on-message already written in the RAM 25, it is neglected. In the case of the note-on-message being not written in, the note-on-message is written in the RAM 25 (step S17). A decision is effected as to whether the play key or the pause key is operated in the operation section 18 by determining whether the pause release state signal indicating the pause release state is supplied from the player controller 7 or not (step S18). If the pause release state signal is not supplied, the process returns to step S15, and a decision is effected as to whether the MIDI signal indicating a note-on-message is newly supplied or not.

If the pause release state signal is supplied, a decision is effected as to whether the note-on-message is written in the RAM 25 or not (step S19). If the note-on-message is written, in the RAM the note-on-message is read out (step S20), and the MIDI signal comprising the read note-on-message is issued from the MIDI controller 24 to the MIDI apparatus 26 (step S21). A decision is effected as to whether other note-on-message is written in the RAM 25 or not (step S22), and if other note-on-message is written, process advances to step S20 and operation of steps S20–S22 is repeated. If other note-on-message is not written in the RAM 25, the process returns to the main routine.

By transfer from the play state the to the pause state, note-off-message corresponding to each note-on-message generating sound then is prepared and any sound generation is at once stopped. A note-on-message obtained repeatedly during pause is written in the RAM 25. If the pause state is released and the play state is restored, any note-on-message written in the RAM 25 then is issued to the MIDI apparatus 26. Consequently, on restoring to the play state, sound is immediately generated.

Next, another embodiment of the invention is shown. In this embodiment, constitution shown in FIG. 4 is used as it is. This embodiment is different from the above-mentioned embodiment in operation of a MIDI controller 24.

Figure 8:
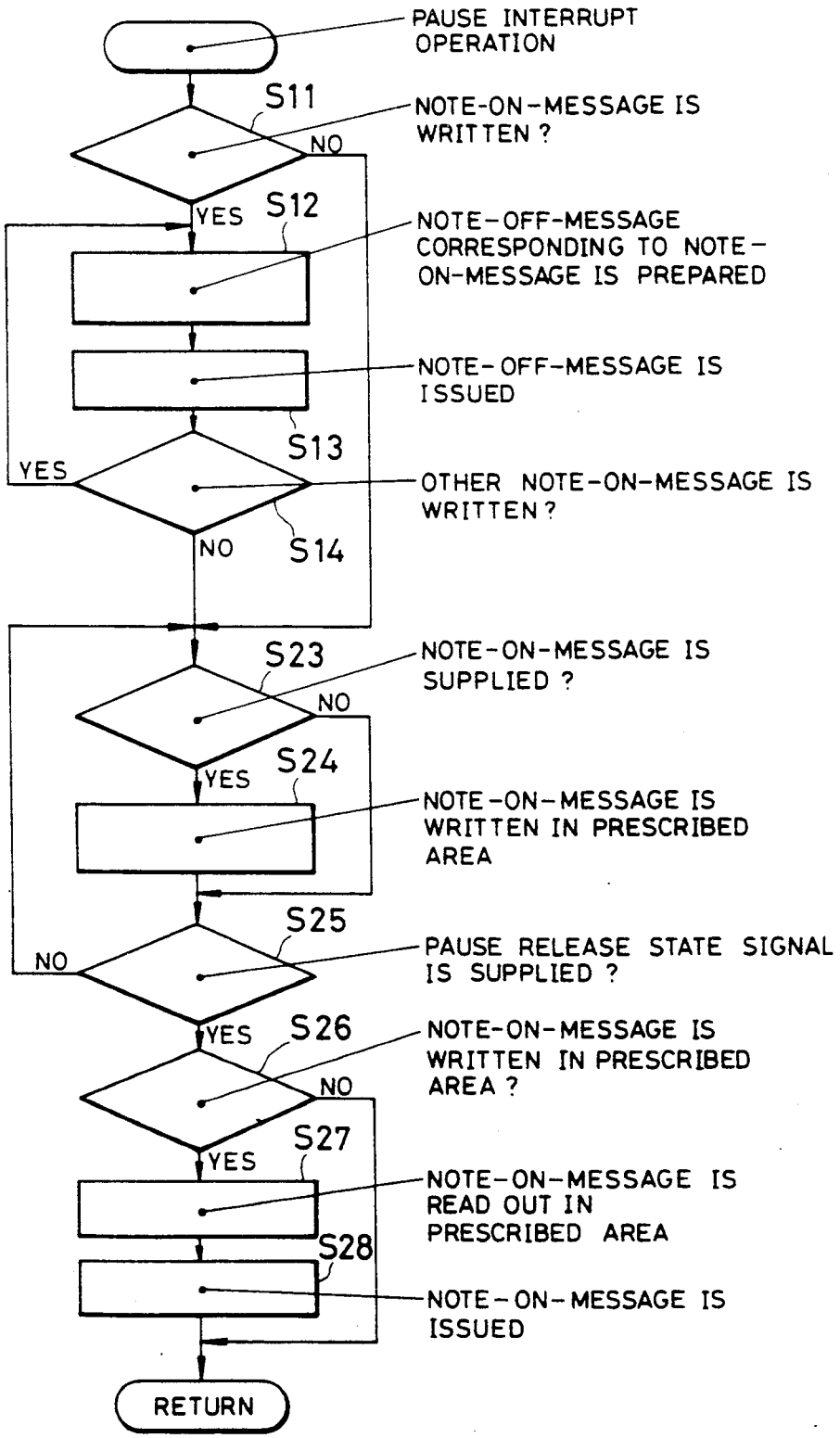
FIG. 8 is a flow chart illustrating control operation of a MIDI controller.

After the pause interrupt operation is started, the MIDI controller 24 executes steps S11–S14 as shown in FIG. 8 and prepares the note-off-message corresponding to each note-on-message generating sound then and any sound generation is at once stopped. This is the same as the operation shown in FIG. 7. And then, a decision is effected as to whether the MIDI signal indicating the note-on-message is supplied or not (step S23). If it is a note-on-message, the note-on-message is written in a prescribed area other than the note-on-area of the RAM 25 (step S24). Decision is effected as to whether the play key or the pause key is operated in the operation section 18 by determining whether the pause release state indicating the pause release state is supplied from the player controller 7 or not (step S25). If the pause release state signal is not supplied the process returns to step S23, and a decision is effected as to whether the MIDI signal indicating a note-on-message is newly supplied or not. If the MIDI signal indicating a note-on-message is newly supplied, the process advances to step S24 and the new note-on-message is written in the prescribed area of the RAM 25 and updated.

If the pause release state signal is supplied, a decision is effected as to whether the note-on-message is written in the prescribed area of the RAM 25 or not (step S26). If the note-on-message is written, in the RAM the note-on-message is read out (step S27), and the MIDI signal comprising the read note-on-message is issued from the MIDI controller 24 to the MIDI apparatus 26 (step S28). The process then returns to the main routine.

In this embodiment, by transfer from the play state to the pause state, the note-on-message generating sound then is read from the RAM 25 and the note-off-message corresponding to each note-on-message is prepared and any sound generation is at once stopped. And then any note-on-message stored in the RAM 25 immediately before pause is erased. The note-on-message obtained repeatedly during pause is updated and written in the prescribed area of the RAM 25. If the pause state is released and the play state is restored, the note-on-message written in the prescribed area of the RAM 25 then is issued to the MIDI apparatus 26. Consequently upon restoration of the play state, the sound is immediately generated.

Figure 9:
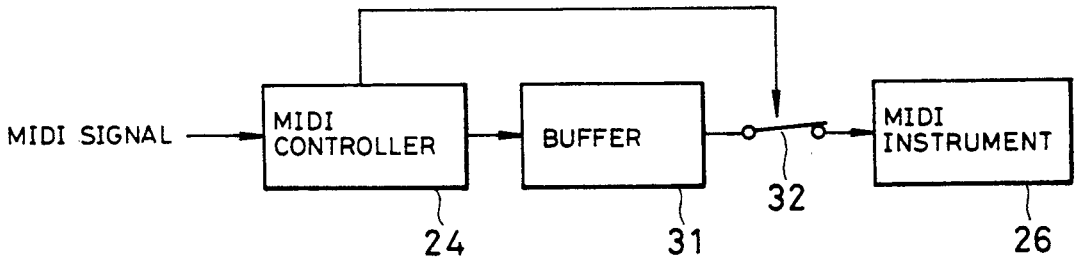
FIG. 9 is a block diagram showing another embodiment of the invention.

In each embodiment as above described, although the MIDI signal is supplied from the MIDI controller 24 directly to the MIDI apparatus 26, the invention is not limited to this but as shown in FIG. 9, a buffer 31 and a switch 32 of FIFO (First-In-First-Out) system may be installed between the MIDI controller 24 and the MIDI apparatus 26. When the buffer 31 and the switch 32 are installed in this manner, after the note-off-message is prepared and any sound generation is once stopped, the switch 32 is turned off, and when the pause state is released, the switch 32 is turned on. A note-on-message to be supplied to the MIDI apparatus 26 upon release of the pause state during the OFF period of the switch 32 is held in the buffer 31, and when the switch 32 is turned on, the note-on-message held in the buffer 31 is supplied through the switch 32 to the MIDI apparatus 26.

When the disc player plays discontinuously due to a track jump, pause, stop or the like, the note-off-message and the control-off-message are forcedly supplied to the MIDI instrument 26, thereby such malfunction can be avoided that the sound of the sound source is not stopped or unnecessary effect state is continued afterwards.

As shown in FIG. 4, if muting switches 28, 29 are installed at both channel outputs of the MIDI instrument and turned on in response to the state signal and made the muting state, the sound can be stopped more securely In the above-mentioned embodiment, although a single MIDI instrument is connected to the MIDI control apparatus, a plurality of MIDI instruments may be connected and the invention can be applied also in this case.

Also the invention is not limited to a disc player, but, for example, may be used when search, pause and stop operations are made in a record medium play apparatus performing a magnetic tape having the instrument play program recorded such as a tape deck.

As above described, according to the invention, the subcode signal from the record medium play apparatus is decoded, and the content of the operation ON signal as the MIDI signal generated by the subcode decoder is stored until the operation OFF signal corresponding to the operation ON signal is generated from the subcode decoder, and the operation OFF signal corresponding to the content of the operation ON signal stored in response to the discontinuous play state signal from the record medium play apparatus is supplied to the MIDI instrument, thereby generation of such malfunction can be prevented and the sound from the MIDI instrument is not stopped in the discontinuous play state of the record medium play apparatus.

We claim:

1. A MIDI control apparatus wherein an operation ON signal and an operation OFF signal are supplied to a MIDI instrument in response to a MIDI format signal included in a subcode signal supplied from a recording medium play apparatus, said control apparatus comprising:

subcode decoder means for decoding the subcode signal received from the recording medium play apparatus and for generating MIDI signals including the operation ON signal and the operation OFF signal;

storage means for storing content of the operation ON signal generated by said subcode decoder means in said control apparatus until the operation OFF signal corresponding to the operation ON signal is generated from said subcode decoder means; and forced release means for supplying the operation OFF signal corresponding to content of the operation ON signal stored in said storage means to said MIDI instrument in response to a state signal representing discontinuous play state from said recording medium play apparatus.

2. A MIDI control apparatus as set forth in claim 1, wherein the discontinuous play state is a pause state of said recording medium play apparatus, a track jump state or a stop state which occurs in the midst of play.

3. A MIDI control apparatus as set forth in claim 1, wherein the operation ON signal is a note-on-message and the operation OFF signal is a note-off-message.

4. A MIDI system which includes a MIDI control apparatus for supplying an operation ON signal and an operation OFF signal to a MIDI instrument in response to a MIDI format signal decoded from a subcode signal supplied from a recording medium player, said system comprising:

means for generating a state signal representing discontinuous play state of said recording medium player;

subcode decoder means for decoding the subcode signal received from said recording medium player and for generating MIDI signals including the operation ON signal and the operation OFF signal;

storage means for storing content of the operation ON signal generated by said subcode decoder means in said MIDI control apparatus until the operation OFF signal corresponding to the operation ON signal is generated from said subcode decoder means; and forced release means for supplying the operation OFF signal corresponding to content of the operation ON signal stored in said storage means into said MIDI instrument in response to the state signal.

* * * * *